US007296832B1

(12) United States Patent
Campbell

(10) Patent No.: US 7,296,832 B1
(45) Date of Patent: Nov. 20, 2007

(54) LOCKING MECHANISM FOR DOOR HINGE

(76) Inventor: John Campbell, 102 Natchez St., Starkville, MS (US) 39759

( * ) Notice: Subject to any disclaimer, the term of this patent is extended or adjusted under 35 U.S.C. 154(b) by 0 days.

(21) Appl. No.: 11/168,773

(22) Filed: Jun. 28, 2005

(51) Int. Cl.
*E05C 19/18* (2006.01)

(52) U.S. Cl. ..... 292/292; 292/DIG. 17; 16/353

(58) Field of Classification Search ..... 292/288, 292/289, 292, DIG. 17, 283, 284; 16/331, 16/332, 352, 353
See application file for complete search history.

(56) References Cited

U.S. PATENT DOCUMENTS 1,151,397 A * 8/1915 Robinson ..... 16/353
2,462,268 A * 2/1949 Kahi ..... 70/1
4,564,974 A * 1/1986 McGrail et al. ..... 16/353
5,590,922 A * 1/1997 Hucknall ..... 292/300
5,727,289 A * 3/1998 Reder ..... 16/375
6,431,621 B1 * 8/2002 De Groot ..... 292/346
6,591,453 B2 * 7/2003 Jenks ..... 16/353

* cited by examiner

*Primary Examiner*—Gary Estremsky
(74) *Attorney, Agent, or Firm*—Garvey, Smith, Nehrbass & North, L.L.C.; Gregory C. Smith

(57) ABSTRACT

A locking mechanism for hinges, which includes a butt hinge of the type securable between a door frame jamb and a door stile, having first and second leaves moveable along a common axis; upper and lower loops formed along the upper and lower edges of the leaf secured to the door frame jamb, the loops extending over the leaf of the door stile when the door is in the closed configuration and the leaves abut one another; and a pin insertable into the upper loop and extending into the lower loop, defining a means for blocking the movement of the stile leaf when force is placed upon the door in order to attempt to open it. The leaves are free to open when the pin is removed.

11 Claims, 1 Drawing Sheet

LOCKING MECHANISM FOR DOOR HINGE

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to locking mechanisms for doors. More particularly the present invention relates to a locking device adaptable to door hinges which maintain a door in a closed position until the device is removed.

2. General Background

Hinged doors, whether providing ingress and egress between rooms are between the interior and exterior of a building are most often equipped with a lock, which is usually a latch of dead bolt on the door face which engages the edge of the distal edge of the door into the door jam. This is for the most part a universal way of locking doors in the closed orientation.

One shortcoming of such a lock is that the locking device, for the most part, is only as strong as the door jam into which it engages. That is, particularly with exterior doors, if a burglar wishes to enter a locked premises, oftentimes the burglar will place such force between the door and the jam, that the jam with give way, and the lock, of course, is no longer engaged. Because of this prevalent shortcoming, there is a need to provide a lock for a door which will not be necessarily dependent upon the strength of the jam into which the door is closed. Or, there is a need for a secondary locking device which may supplement the usual dead bolt or other standard door lock.

SUMMARY OF THE PRESENT INVENTION

A locking mechanism for door hinge, usually referred to as a butt hinge, of the type securable between a door frame jamb and a door stile, having first and second leaves moveable along a common axis; upper and lower loops formed along the upper and lower edges of the leaf secured to the door frame jamb, the loops extending over the leaf of the door stile when the door is in the closed configuration and the leaves abut one another; and a pin insertable into the upper loop and extending into the lower loop, blocking the movement of the stile leaf when force is placed upon the door in order to attempt to open it, and when the pin is removed, the leaves are free to open. The locking mechanism would be placed on one or more of the hinges of the door.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Figure 1:
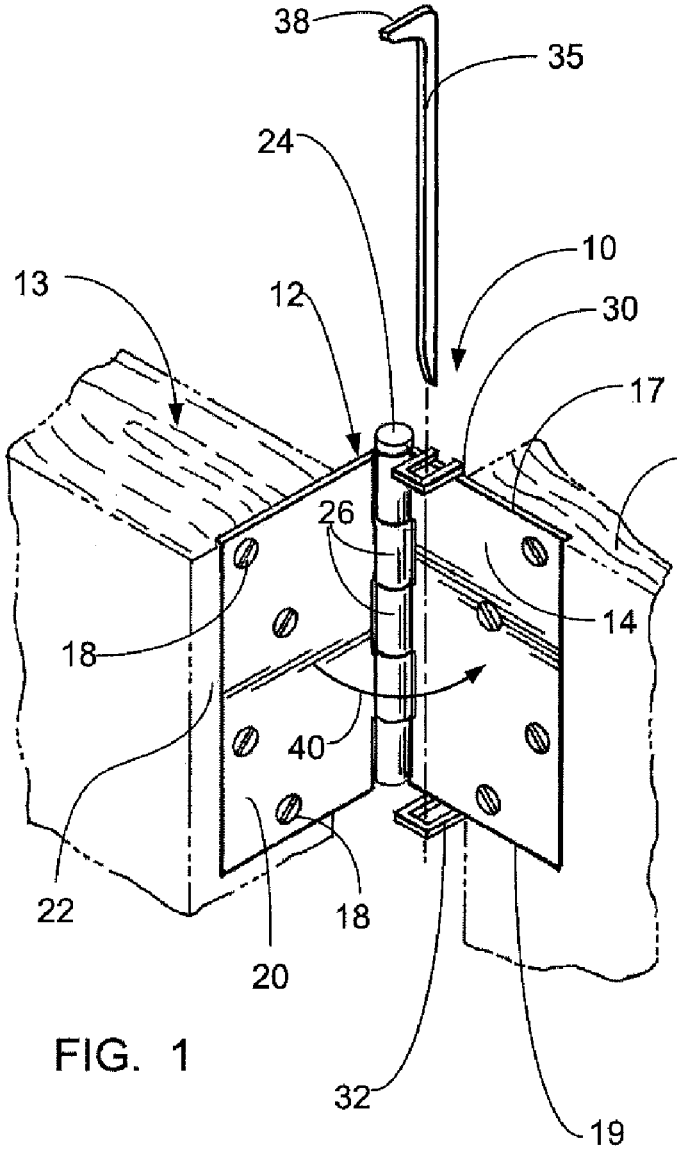
FIG. 1 illustrates an overall view of the hinge locking mechanism mounted to an open door.
Figure 2:
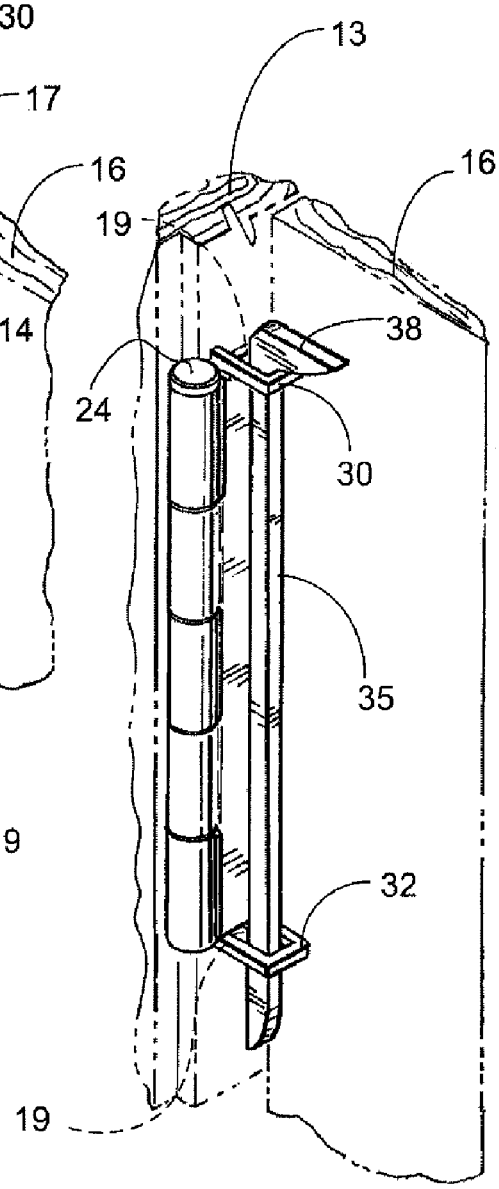
FIG. 2 illustrates an overall view of the hinge locking mechanism mounted to a closed door and locked in position.

FIGS. 1 and 2 illustrate the preferred embodiment of the present invention by the numeral 10. As illustrated the locking mechanism 10 is incorporated into a standard door hinge 12, which comprises a first leaf 14 mounted on a door frame jamb 16, through a plurality of screws 18 securing the leaf 14 against the jamb 16. There is provided a second leaf 20 secured to the door stile 22 via a plurality of screws 18, the first and second leaves 14, rotatingly mounted to one another via a hinge pin 24 secured through interfitting collars 26 in each leaf 14, 20. This type of hinge is standard in the building industry, and is usually referred to as butt hinge 12. The hinge 12, as seen in the Figures, allows the door 13 to swing between an open position as seen in FIG. 1, where the hinge leaves 14, 20 are exposed, to the closed position as seen in FIG. 2, where the leaves 14, 20 abut one another between the closed door stile 22 and the frame jamb 16. In most cases, the leaves 14, 20 are secured in recessed formed in the stile 22 and jamb 16, so that the door 13, when closed, is able to but up against the frame jamb 16 for a more secure fit.

Reference is now made to the locking mechanism 10 which is an integral part of the modified hinges 12, as seen in FIGS. 1 and 2. As stated earlier, in FIG. 1, the door 13 is in the open position away from the door jamb 16. There is illustrated a loop member 30 secured to the upper edge 17 of the leaf 14 secured to the door jamb 16, having a loop opening 19. The loop member 30 would be integrally secured to the leaf edge 17 via welding or molded in place, and would extend sufficiently out away from the leaf 14, defining an opening 19, for the reasons explained latter. There is also a second loop 32 secured to the lower edge 19 of the leaf 14, which would be vertically aligned with upper loop 30, likewise defining an opening 19, so that a pin 35 may be inserted into the opening 19 of the first loop 30 and extend downward into and through the opening 19 in the second loop 32. There is provided a head 38 on pin 35 which prevents the pin 35 from sliding through the loops 30, 32 when in place, with the head 38 of pin 35 resting on the upper loop 30, as seen in FIG. 2.

Turning now to FIG. 2, the door 13 has been swung closed from its open position in FIG. 1, in the direction of arrow 40, so that the leaves 14, 20 abut one another, in when in that position, the loops 30, 32 have overlapped past the hinge leaf 20, so that the loop openings 19 are accessible for the pin 35 to be inserted. When the pin 35 is inserted in position, as seen in FIG. 2, should one attempt to open the door 13, the pin 35 would prevent the hinge leaves 14, 20 from moving apart, and the door 13 would be in effect, locked closed. Of course, all one must do is remove the pin 35 from loops 30, 32, and the door would be free to open, assuming the door lock is disengaged.

It is foreseen that the locking mechanism described above would be used on at least one hinge 12, but preferably would be used on all of the hinges 12, which serve to lock a door 13 to a door jamb 16 more securely. With a plurality of these locking mechanisms 10 positioned on multiple hinges 12, the integrity of the system would be more assured as a means for locking a door closed. Also, it is foreseen that this locking device could be retrofitted onto existing hinges, through welding the loops 30, 32 to the hinge leaf 14 mounted on the jamb 16, or they could be sold as hinges 12 which are modified with the locking mechanism in place.

It is also understood that this locking device 10 for door hinges 12 could be either the primary or secondary means for locking a door closed; but, would in any even add an additional layer of protection from a closed door being forced open when the door lock is compromised.

All measurements disclosed herein are at standard temperature and pressure, at sea level on Earth, unless indicated otherwise.

PARTS LIST

10 locking mechanism
12 door hinge
13 door
14 first leaf
16 door frame jamb
17 upper leaf edge
18 screws
19 lower leaf edge
20 second leaf
22 door stile
24 hinge pine
26 collars
30 upper loop member
32 lower loop member
33 openings
35 pin
38 head
40 arrow All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A locking door hinge, comprising:

a) a first leaf having a thickness, an inner edge, an outer edge, upper and lower edges, first and second planar surfaces, and a plurality of pin receptive sleeves extending along the inner edge, each sleeve having a sleeve bore;

b) a second leaf having a thickness, an inner edge, an outer edge, upper and lower edges, first and second planar surfaces, and a plurality of pin receptive sleeves extending along the inner edge, each sleeve having a sleeve bore;

c) the sleeves of the first and second leaves being offset, enabling the sleeve bores to be aligned along a common axis that defines a hinge pivot;

d) a pivot pin that extends through the sleeve bores, enabling the leaves to move between open and closed positions, the outer edges of the leaves being next to each other in the closed position;

e) a pair of locking flanges placed on the edges of the first leaf at a position that is spaced away from the sleeves;

f) each flange having a locking pin receptive flange opening;

g) the flange opening being spaced a distance from the first leaf that is greater than the thickness of the second leaf;

h) a locking pin that is removably connectable to the flanges at the flange openings in a locking position; and i) wherein in the locking position, the leafs are in the closed position and the locking pin constrains movement of the second leaf relative to the first leaf by contacting a planar surface of the second leaf at a position that is spaced in between the leaf inner and outer edges.

2. The locking door hinge of claim 1, wherein the at least one of the flanges is connected to the leaf at a position that extends along a leaf edge in between the inner and outer edges.

3. The locking door hinge of claim 1, wherein the at least one of the flanges is connected to the leaf at a position that extends along a leaf planar surface in between the inner and outer edges.

4. The locking door hinge of claim 1, wherein in the locking position, a planar surface of the second leaf transfers a shear load to the locking pin.

5. The locking door hinge of claim 1, wherein at least one of the flanges occupies a plane generally perpendicular to the hinge axis and the locking pin is generally parallel to the hinge axis in the locking position.

6. The locking door hinge of claim 1, wherein the flanges are placed respectively on the upper and lower edges of the first leaf.

7. The locking door hinge of claim 1, wherein the second leaf contacts the locking pin continuously between the upper and lower leaf edges.

8. The locking door hinge of claim 1 wherein the locking pin does not connect to any of the sleeves.

9. The locking door hinge of claim 1 wherein only sleeves are connected to the leaf inner edges and the locking pin does not connect to any sleeve.

10. A locking door hinge, comprising:

a) a first leaf having a thickness, a planar surface, an inner edge, an outer edge, upper and lower edges, and a plurality of pin receptive sleeves extending along the inner edge, each sleeve having a sleeve bore;

b) a second leaf having a thickness, an inner edge, an outer edge, upper and lower edges, and a plurality of pin receptive sleeves extending along the inner edge, each sleeve having a sleeve bore;

c) the sleeves of the first and second leaves being offset, enabling the sleeve bores to be aligned along a common axis that defines a hinge pivot;

d) a pivot pin that extends through the sleeve bores enabling the leaves to move between open and closed positions, the outer edges of the leaves being next to each other in the closed position;

e) a pair of locking flanges placed on the edges of the first leaf at a position that is spaced away from the sleeves;

f) each flange having a locking pin receptive opening;

g) the locking pin opening being spaced a distance from the first leaf that is greater than the thickness of the second leaf;

h) a locking pin that is removably connectable to the flanges at the flange openings in a locking position; and i) wherein in the locking position, the leaves are in the closed position and the locking pin constrains movement of the second leaf relative to the first leaf by transferring shear load to the pin via the flanges and the planar surface of the second leaf in between the flanges.

11. An improved locking door hinge, having a first leaf having a thickness, a planar surface, an inner edge, an outer edge, upper and lower edges, and a plurality of pin receptive sleeves extending along the inner edge, each sleeve having a sleeve bore; a second leaf having a thickness, an inner edge, an outer edge, upper and lower edges, and a plurality of pin receptive sleeves extending along the inner edge, each sleeve having a sleeve bore; the sleeves of the first and second leaves being offset, enabling the sleeve bores to be aligned along a common axis that defines a hinge pivot; and a pivot pin that extends through the sleeve bores enabling the leaves to move between open and closed positions, the outer edges of the leaves being next to each other in the closed position; the improvement comprising:

a) a pair of locking flanges placed on the edges of the first leaf at a position that is spaced away from the sleeves;

b) each flange having a locking pin receptive opening;

c) the locking pin opening being spaced a distance from the first leaf that is greater than the thickness of the second leaf;

d) a locking pin that is removably connectable to the flanges at the flange openings in a locking position;

e) wherein in the locking position, the leaves are in the closed position and the locking pin constrains movement of the second leaf relative to the first leaf by transferring shear load to the pin via the flanges and the planar surface of the second leaf in between the flanges.

* * * * *